US005150084A

United States Patent [19]

Asa et al.

[11] Patent Number: 5,150,084

[45] Date of Patent: Sep. 22, 1992

[54] POWER DIVIDER

[75] Inventors: Masahito Asa; Masayuki Nakajima, both of Tokyo, Japan

[73] Assignee: Tokimec, Inc., Tokyo, Japan

[21] Appl. No.: 662,139

[22] Filed: Feb. 28, 1991

[30] Foreign Application Priority Data

Feb. 28, 1990 [JP] Japan ..... 2-48562

[51] Int. Cl.[5] ..... H01P 5/12

[52] U.S. Cl. ..... 333/128; 333/204

[58] Field of Search ..... 333/100, 124–128, 333/204

[56] References Cited

U.S. PATENT DOCUMENTS

| | | | |
|---|---|---|---|
| 4,460,877 | 7/1984 | Sterns | 333/204 X |
| 4,835,496 | 5/1989 | Schellenberg et al. | 333/128 |
| 4,851,795 | 7/1989 | Beckwith | 333/100 |
| 4,851,797 | 7/1989 | Nakamura | 333/204 X |
| 5,025,233 | 6/1991 | Leonakis | 333/128 |

FOREIGN PATENT DOCUMENTS

| | | | |
|---|---|---|---|
| 1330408 | 9/1973 | United Kingdom | 333/128 |

OTHER PUBLICATIONS

"Microwave Filters", Impedance-Matching Networks, and Coupling Structures, G. L. Matthael, McGraw-Hill Book Company.

"Foundation for Microwave Engineering", R. E. Collins, McGraw-Hill Book Company.

"A Class of Broadband Three-Port Ten-Mode Hybrids", S. B. Conn, IEEE Transactions on Microwave Theory and Techniques, vol. MTT-16, No. 2, Feb. 1968.

"A Novel Class of Generalized Chebyshev Low-Pass Prototype for Suspended Substrate Stripline Filters", S. A. Alseyab, IEEE Transactions on Microwave Theory and Technique, vol. MTT-30, No. 9, Sep. 1982.

*Primary Examiner*—Paul Gensler

*Attorney, Agent, or Firm*—Lowe, Price, LeBlanc & Becker

[57] ABSTRACT

A distributed-line power divider comprising: a common port and n distributing ports adapted to be connected with respective external lines; and n impedance transformers disposed between the common port and the distributing ports and having a filter function. The filter function of the impedance transformers may be a low-pass filter, a high-pass filter or a band-pass filter.

21 Claims, 7 Drawing Sheets

POWER DIVIDER

BACKGROUND OF THE INVENTION

1. Field of the Invention

This invention relates generally to a power divider suitable for microwave bands, and more particularly to a distributed-line power divider having a filter function.

2. Description of the Related Art

A power divider and a filter are useful as circuit elements in a microwave circuit of a microwave transmitter, receiver or the like.

Currently, power dividers of the described type are known which comprise, as shown in FIG. 10 of the accompanying drawings, a pair of quarter-wavelength transformers 31, 32 disposed between a common port 1 and a pair of distributing ports 2, 3. In the power divider, the microwave power inputted from the common port 1 is equally divided by the distributing ports 2, 3, and reversely the microwave powers inputted in phase from both the distributing ports 2, 3 are composed and then outputted to the common port 1. This prior divider is disclosed in, for example, an article "A Class of Broadband Three-Port TEM-Mode Hybrid" (S. B. Cohn) in IEEE TRANSACTIONS ON MICROWAVE THEORY AND TECHNIQUES, Vol. MTT-16, No. 2, February 1968, pages 110–116.

In the meantime, a known filter is exemplified by a low-pass filter such as shown in FIG. 11 which has open stubs 34 connected to a high-impedance line 33. This prior filter is disclosed in, for example, a book "Microwave Filters, Impedance-Matching Networks, and Coupling Structures" (G. L. Matthaei, L. Young and E. M. T. Jones) McGraw-Hill Book Company 1984.

In microwave circuits, it has currently been a common practice to use a filter as connected in series with a power divider. However, the filter and the power divider are separate circuit elements independent of each other and, therefore, the number of total parts to be used in the circuit is increased, which will result in a large-sized circuit. Particularly for realizing a microwave circuit in an IC form, the number of total parts must be reduced to minimize the area which is to be occupied by the circuit elements.

Furthermore, because quarter-wavelength transformers are used, the prior power divider is necessarily large in size. For example, in the case of FIG. 10, the length L2 between the end of the distributing common port 1 and the end of the distributing ports 2, 3 is about 60 mm.

SUMMARY OF THE INVENTION

It is therefore an object of this invention to provide a power divider in which small-sized circuit elements are combined in a hybrid form having both the power divider function and the filter function, enabling reduction of the number of needed parts.

According to a first aspect of the invention, there is provided a power divider, which has a conductor base, a dielectric and a strip conductor, for dividing and composing microwave power, the divider comprising: a common port and n distributing ports adapted to be connected to respective external lines; and n impedance transformers having a filter function and disposed each between the common port and a respective one of the n distributing ports.

According to a second aspect of the invention, there is provided a power divider comprising: a common port and N distributing ports; and N low-pass filters each having an impedance transformer function and disposed between the common port and a respective one of the N distributing ports. The filter may includes one or more impedance lines having a higher impedance than a characteristic impedance on the distributing port side, and a resonator.

With the first aspect of the invention, input microwave power from the common port can be divided to the respective distributing ports by the function of the impedance transformer between the common port and the distributing ports. If the transformation ratio is set to n:1 (n is the number of the distributing ports), the microwave power is equally divided.

Further, since the filter function is provided between the common port and each of the distributing ports, input microwave power from the common port is divided and outputted to the individual distributing ports as a suitable frequency is selected according to the filter characteristic. When microwave powers are inputted in phase from each of the distributing ports, microwave power composed from the common port is obtained. In this case, the filter functions as well, microwave power as a suitable frequency is selected according to the filter characteristic.

Thus since the power divider has both a divider function and a filter function, it is possible to combine circuit elements into a hybrid form, reducing the total part number. Namely, it is possible to realize these two functions with a small-sized structure as large as the power divider or the filter. It is therefore possible to realize a distributed-line power divider or filter so as to occupy only a small area as the associated elements or parts are reduced to a minimum.

DETAILED DESCRIPTION

The principles of this invention are particularly useful when embodied in a power divider such as shown in FIGS. 1 through 9.

Figure 1:
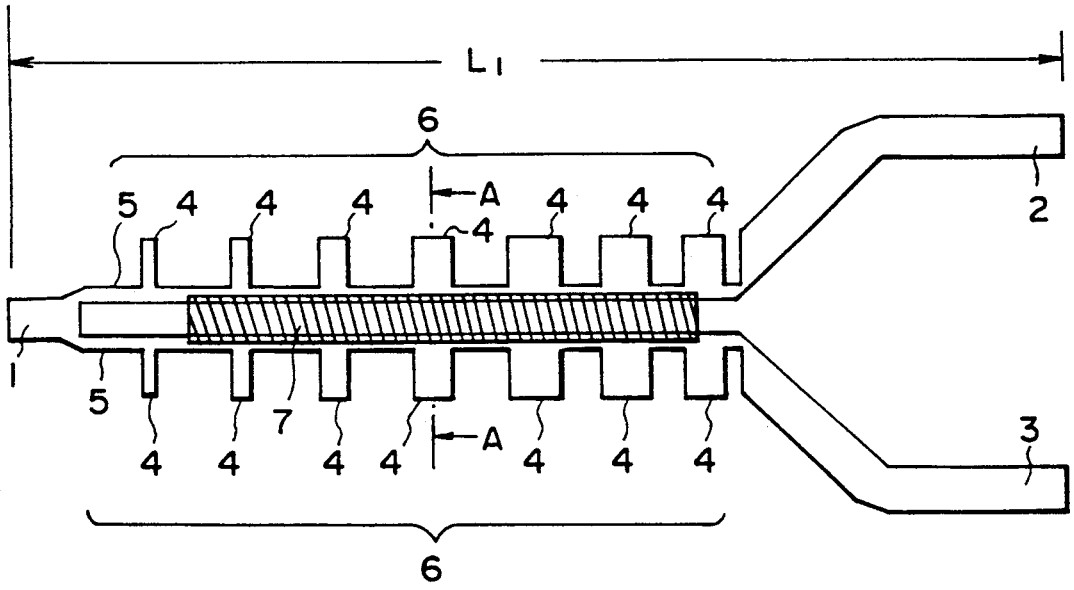
FIG. 1 is a schematic plan view showing a strip-line pattern to be used in a first embodiment of a power divider according to this invention.
Figure 2:
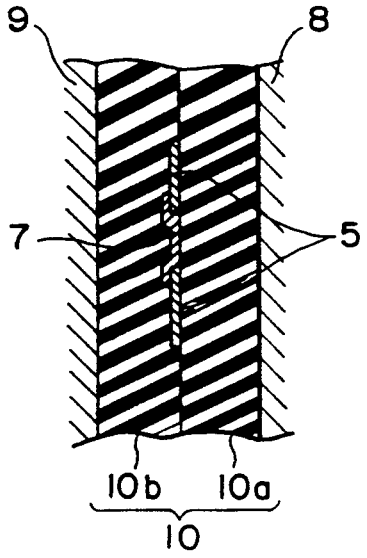
FIG. 2 is a cross-sectional view taken along line A—A of FIG. 1.

FIGS. 1 and 2 show a first embodiment of the power divider, in which a tri-plate strip line is used and which has a low-pass filter characteristic.

The power divider of this embodiment comprises a common port 1, two distributing ports 2, 3, two impedance transformers 6, 6 disposed between the common port 1 and the distributing ports 2, 3 and having a low-pass filter function, an isolation resistor 7 extending between the two impedance transformers 6, 6, two dielectrics 10*a*, 10*b* supporting these elements and two conductor bases 8, 9 holding the dielectrics 10*a*, 10*b* therebetween.

Each of the impedance transformers 6 is in the form of a high-impedance impedance line 5 connecting the common port 1 with a respective one of the distributing ports 2, 3 and provided with open stubs 4.

In this embodiment, since two impedance transformers 6, 6 are arranged in parallel to each other, their impedances are set in such a manner that the transformation ratio is 2:1. The number of the impedance transformers 6 should by no means be limited to two (2) and may be any larger number. Therefore, assuming that many (n) impedance transformers 6 are used, the impedance of the impedance transformer assembly is set in such a manner that the transformation ratio is n:1.

The projected length, the width and the number of the open stubs 4 are suitably set according to the filter characteristic and the transformation ratio n:1. In this embodiment, the impedance transformer 6 constitutes a low-pass filter such that the cut-off frequency is 20 GHz. This setting can be performed by, for example, finding out the optimum value mathematically or using an optimization algorithm by a computer.

The common port 1, the two distributing ports 2, 3, and the impedance transformers 6, 6 are formed by photo-etching the conductive layer on the dielectric 10*a* according to a preset pattern. Namely, each pattern is formed of the conductive layer.

The isolation resistor 7, as indicated by hatching in FIG. 1, is disposed between the two parallel impedance lines 5, 5 in such a manner that the two longitudinal marginal portions of the isolation resistor 7 overlap the respective confronting edge portions of the two impedance lines 5, 5, thus to avoid problems which may otherwise arise depending on whether or not the isolation resistor 7 is in direct contact with the impedance lines 5, 5. Referring to the shape of the isolation resistor 7, as it would be complicated to obtain the solution mathematically and there is no specified solution, various shapes may be used.

For assembly, the common port 1, the two distributing ports 2, 3, the impedance transformers 6, 6, and the isolation resistor 7 are formed on the dielectric 10*a*, whereupon the dielectric 10*b* is placed over the dielectric 10*a*. These laminated dielectrics are sandwiched between the two conductor bases 8, 9. Each of the dielectrics 10*a*, 10*b* may comprise synthetic resin such as Teflon (trade name).

Assuming that microwave power from the common port 1 is incident on the thus constructed power divider, the incident power is equally divided and outputted from the distributing ports 2, 3. At that time, the open stubs 4 act as a resonator of a low-pass filter to cut off the microwave power of frequencies over 20 GHz so that the microwave power of frequencies lower than 20 GHz is selectively outputted to the distributing ports 2, 3. The experimental insertion-loss and return-loss characteristics are obtained as shown in FIG. 3.

Figure 3:
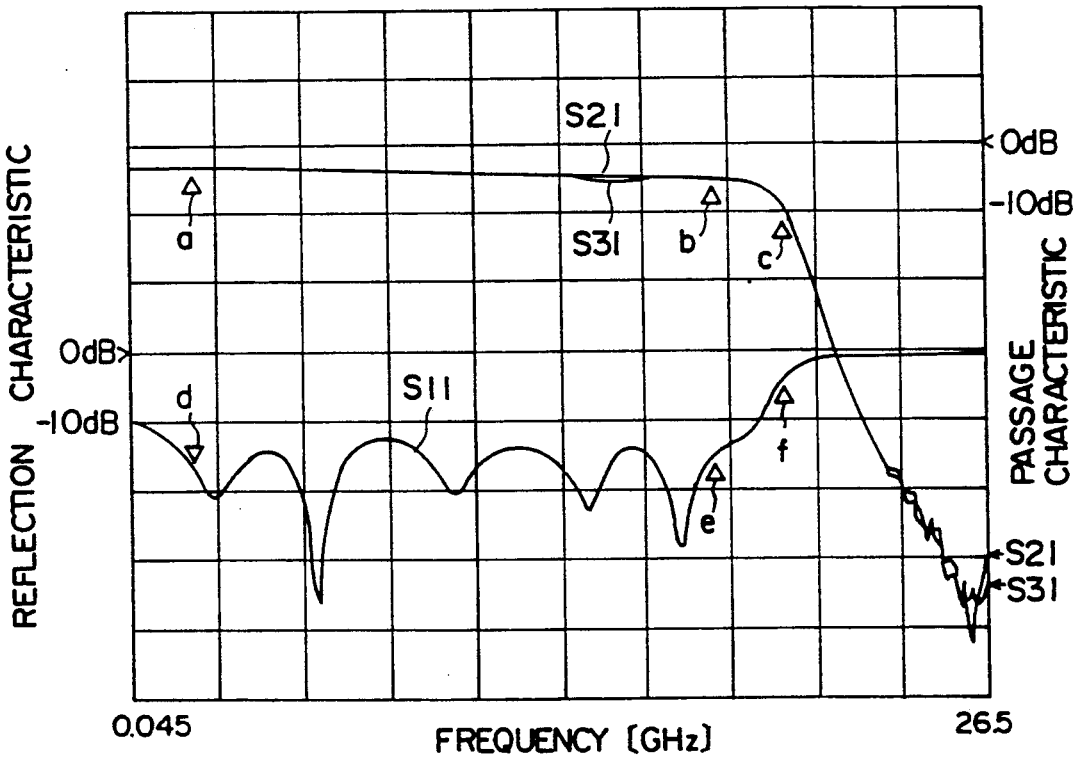
FIG. 3 is a graph showing a passage characteristic and a reflection characteristic of the power divider of FIG. 1.

In FIG. 3, the values on the abscissa are frequencies ranging from 0.045 to 26.5 GHz. The values on upper and lower parts of the ordinate are amounts of attenuation in terms of 0 dB to 10 dB for the transmission characteristic and the reflection characteristic, respectively.

The experimental results shown in FIG. 3 indicate that the transmission characteristic S21 from the common port 1 to the distributing port 2 and the passage characteristic S31 from the common port 1 to the distributing port 3 were equally divided as attenuated by −3.31 dB at the frequency (2 GHz) designated by a. These transmission characteristics were attenuated by −5 dB at the frequency (18 GHz) designated by b and hence was divided into substantially equal outputs at the range of 2 to 18 GHz. They were attenuated sharply from near the frequency (20 GHz) designated by c and then was attenuated by more than −60 dB at the frequency of 26.5 GHz.

The transmission characteristic S21 and the transmission characteristic S31 are identical with each other, except that there was some difference at high frequency band.

Further, the reflection characteristic S11 at the common port exceeded −12 dB in the frequency range between d and e in FIG. 3 and approached 0 dB in the frequency range above f (20 GHz). Thus in the range of 2 to 18 GHz, the reflection became reduced for the input from the common port 1.

Figure 4:
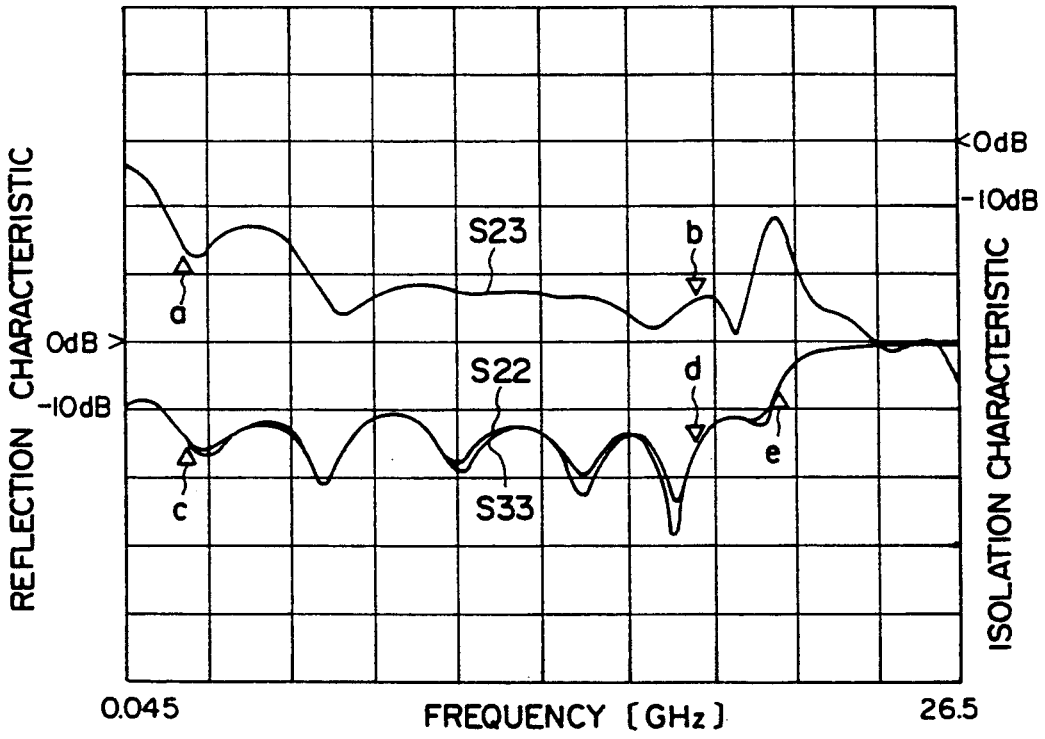
FIG. 4 is a graph showing an isolation of the power divider of FIG. 1 and also a reflection characteristic at the distributing ports.

FIG. 4 shows the isolation characteristic, and the reflection characteristic at the distributing ports. In this figure, the values on the abscissa are the frequencies ranging from 0.045 to 26.5 GHz. The values on upper and lower parts of the ordinate are the isolation characteristic and the reflection characteristic at the distributing ports, respectively, both in terms of 0 dB to 10 dB.

The experimental results shown in FIG. 4 indicate that the isolation characteristic S23 to examine what amount of the microwave power inputted from the distributing port 3 leaked to the distributing port 2 was −23.79 dB at the frequency (18 GHz) designated by b. Thus a great isolation effect was produced.

The respective reflection characteristics S22 and S33 when microwaves were inputted from the respective distributing ports 2, 3 were larger than −16.30 dB at the frequency designated by d and approached 0 dB at the frequency higher than the frequency at e (20 GHz). Thus in the range of 2 to 18 GHz, the reflection became reduced for the inputs from the respective distributing ports 2, 3. Therefore, composing of the powers can be performed in this range.

The power divider of this embodiment has the characteristic of the divider at the frequency below 20 GHz and the cut-off characteristic of the low-pass filter at the frequency over 20 GHz.

Figure 11:
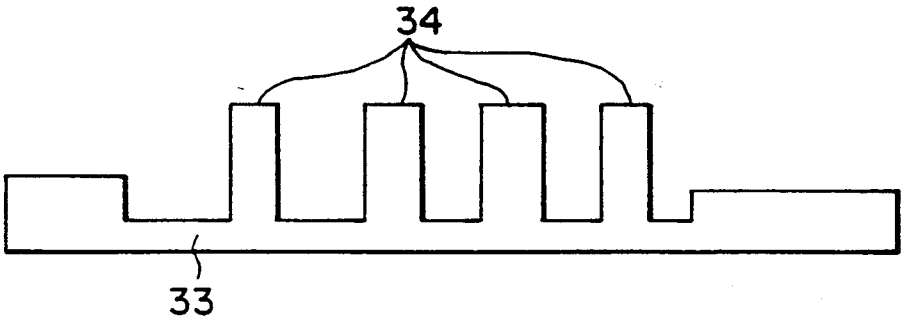
FIG. 11 PRIOR ART
FIG. 11 is a schematic plan view showing a prior art low-pass filter.

In this power divider, the length L1 between the end of the common port 1 and the ends of the distributing ports 2, 3 is about 30 mm, and is therefore small in size compared to the prior art divider of FIG. 11 using quarter-wavelength transformers.

In this embodiment, a tri-plate strip line is used. Alternatively a micro strip line may be used; in this case, for example, the isolation resistor is formed on the dielectrics such as by a thin film technology, whereupon the common port 1, the two distributing ports 2, 3, and the impedance transformers 6 are formed.

Figure 5:
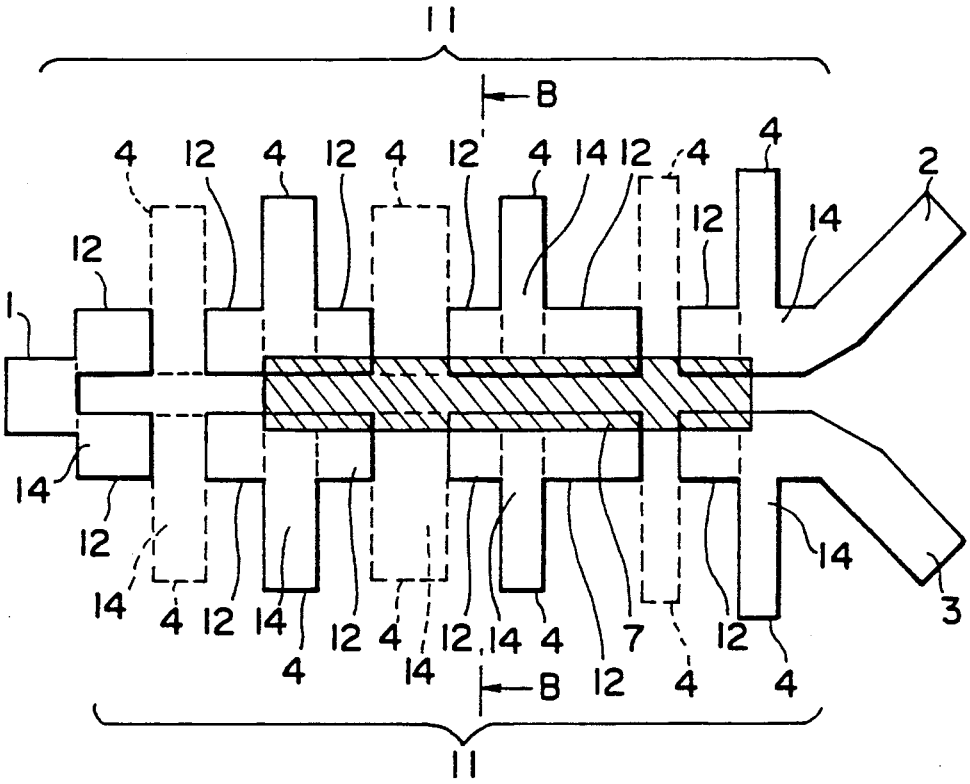
FIG. 5 is a schematic plan view showing a strip-line pattern to be used in a second embodiment of the power divider.
Figure 6:
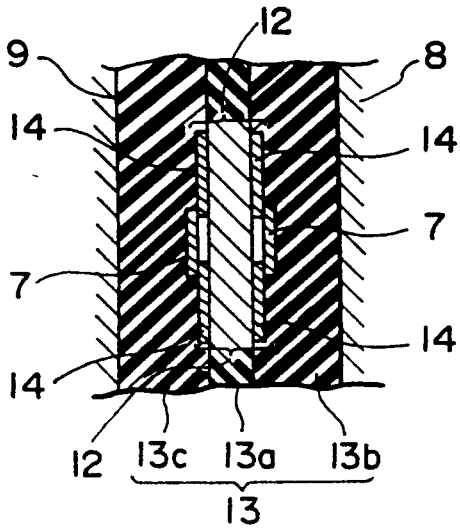
FIG. 6 is a cross-sectional view taken along line B—B of FIG. 5.

FIGS. 5 and 6 show a second embodiment using a tri-plate strip line and having a high-pass filter characteristic.

The power divider of the second embodiment comprises a common port 1, two distributing ports 2, 3, two impedance transformers 11, 11 disposed between the common port 1 and the two distributing ports 2, 3 and having a high-pass filter function, two isolation resistors 7 extending between the two impedance transformers 11, 11, three dielectrics 13*a*, 13*b*, 13*c* supporting the impedance transformers 11, 11 and the isolation resistors 7, and two conductor bases 8, 9 holding the dielectrics 13*a*, 13*b*, 13*c* therebetween. In this embodiment, parts or elements similar to those of the previous embodiment are designated by the same reference numerals.

Each of the impedance transformers 11 includes a capacitor array of a plurality of series-connected capacitors 12 connecting the common port 1 with the two distributing ports 2, 3, and a plurality of open stubs 4 provided along with each capacitor array.

In this embodiment, since two impedance transformers 11, 11 are arranged in parallel to each other, their impedances are set in such a manner that the transformation ratio is 2:1. The number of the impedance transformers 11 should by no means be limited to two (2) and may be any larger number. Therefore, assuming that many (n) impedance transformers 11 are used, the impedance of the impedance transformer assembly is set in such a manner that the transformation ratio is n:1.

The capacitors 12, as shown in FIGS. 5 and 6, are composed of a plurality of conductors 14 which are alternately provided on the opposite sides of the dielectric 13*a* and are connected in series as the capacitor array. By the capacitors 12 and the open stubs 4, it is possible to select a cut-off frequency as desired. The structure and the number of connecting steps of the capacitors 12 as well as the projected length, the width and the number of the open stubs 4 can be set as desired according to the filter characteristic and the transformation ratio n:1. This setting can be performed by finding out the optimum value mathematically or using an optimization algorithm by a computer.

The common port 1, the two distributing ports 2, 3, and the impedance transformers 11, 11 are formed by photo-etching the conductive layers on opposite sides of the dielectric 10*a* according to a preset pattern.

The isolation resistors 7, as indicated by hatching in FIG. 5, are disposed between the two parallel impedance transformers 11, 11 in such a manner that the two longitudinal marginal portions of each isolation resistor 7 overlap the respective confronting edge portions of the two impedance transformers 11, 11, thus avoiding problems which may otherwise arise depending on whether or not the isolation resistor 7 is in direct contact with the impedance transformers 11, 11. The isolation resistors 7, 7 are disposed one on each side of the dielectric 13*a*. Alternatively, the isolation resistor 7 may be disposed on only one side of the dielectric 13*a*.

The isolation resistors 7, 7 may be mounted one on each of the dielectrics 13*b*, 13*c*.

For assembly, the common port 1, the two distributing ports 2, 3, and the impedance transformers 11, 11 are found on the dielectric 13*a*, while the isolation resistor 7, 7 are formed one on each of the dielectric 13*b*, 13*c*, whereupon the dielectrics 13*b*, 13*c* are placed one after another over the dielectric 13*a*. Three laminated dielectrics are sandwiched between the two conductor bases 8, 9 which jointly constitute a casing. Each of the dielectrics 13*a*, 13*b*, 13*c*, like the dielectrics 10*a*, 10*b* of the first embodiment, may comprise synthetic resin such as Teflon (trade name).

Assuming that microwave power from the common port 1 is incident on the thus constructed power divider, the incident power is equally divided and outputted from the distributing ports 2, 3. At that time, the capacitors 12 and the open stubs 4 act as a resonator of a high-pass filter to cut off the microwave power of frequencies below the cut-off frequency so that the microwave power of frequencies higher than cut-off frequency are selectively outputted to the distributing ports 2, 3. The same thing can be said when the microwave powers inputted in phase from the individual distributing ports 2, 3 are composed for being outputted from the common port 1.

Figure 7:
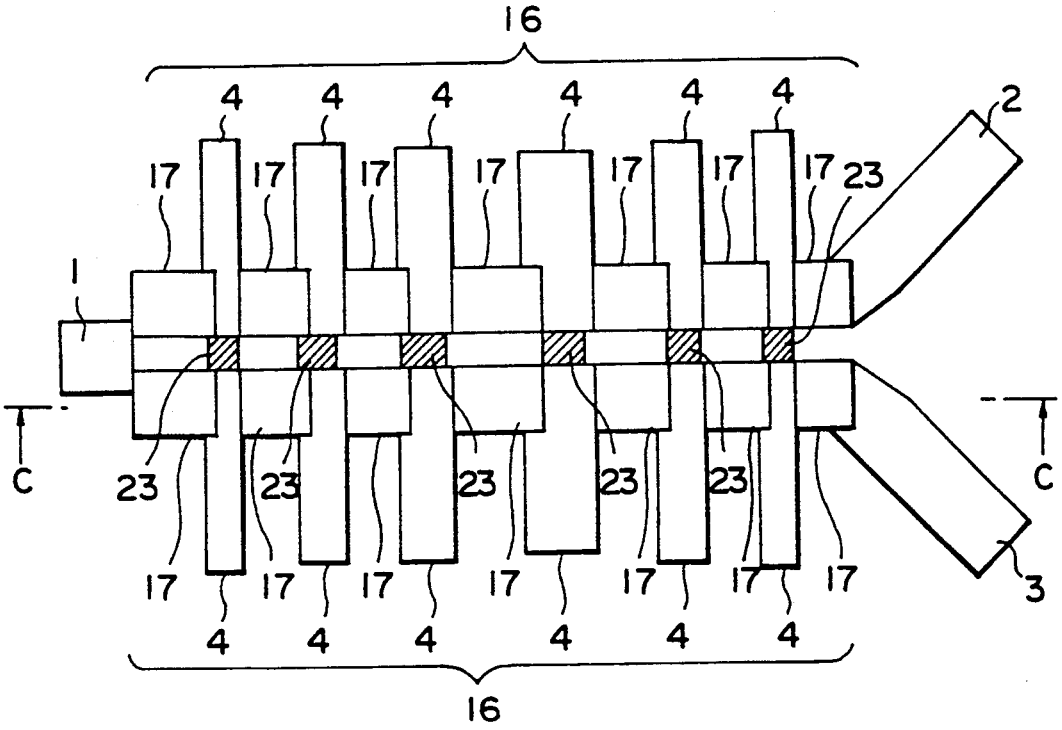
FIG. 7 is a schematic plan view showing a strip-line pattern to be used in a third embodiment of the power divider.
Figure 8:
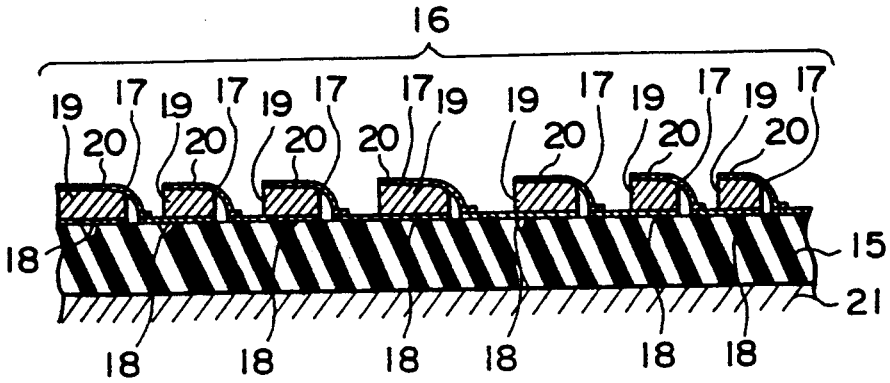
FIG. 8 is a cross-sectional view taken along line C—C of FIG. 7.

FIGS. 7 and 8 show a third embodiment which uses a micro strip line and has a high-pass filter characteristic.

The power divider of the third embodiment comprises a common port 1, two distributing ports 2, 3, two impedance transformers 16, 16 connecting the common port 1 with the two distributing ports 2, 3 and having a high-pass filter function, plural isolation resistors 23, and a dielectric base 15 supporting the ports 1, 2, 3, the impedance transformers 16, 16 and the isolation registors 23. In this embodiment, parts or elements similar to those of the previous embodiments are designated by the same reference numerals.

Each of the impedance transformers 16 is in the form of capacitors 17 connecting the common port 1 with a respective one of the distributing ports 2, 3 and provided with open stubs 4, the capacitors 17 being connected in series as two capacitor arrays.

In this embodiment, since two impedance transformers 16, 16 are arranged in parallel to each other, their impedances are set in such a manner that the transformation ratio is 2:1. The number of the impedance transformers 16 should by no means be limited to two (2) and may be any larger number. Therefore, assuming that many (n) impedance transformers 16 are used, the impedance of the impedance transformer assembly is set in such a manner that the transformation ratio is n:1.

The capacitors 17, as shown in FIGS. 7 and 8, are assembled by forming a plurality of lower conductive layers 18 arranged discretely on one surface of the dielectric base 15, and a dielectric 19 is laminated over part of each lower conductive layer 18, whereupon an upper conductive layer 20 is placed over the respective dielectric 19. Each upper conductive layer 20 is connected at one end to the succeeding lower conductive layer 18 so that the plural capacitors 17 are connected in series. The upper layer 20 comprises a metal tape such as a gold foil, an aluminum foil, etc. This invention should by no means be limited to these examples.

Each lower conductive layer 18 is provided with an open stub 4. A conductor base 21 is located on the under side of the dielectric base 15.

The capacitors 17, each of which includes the lower conductive layer 18, the dielectric chip 19 and the upper conductive layer 20, and the open stubs 4 are set so as to jointly constitute a high-pass filter such that a given frequency is regarded to be a cut-off frequency. The element structure and the number of connecting steps of the capacitors 17 as well as the projected length, the width and the number of the open stubs 4 are determined as desired according to the filter characteristic and the transformation ratio n:1. This setting can be performed by, for example, finding out the optimum value mathematically or using an optimization algorithm by a computer.

The isolation resistors 23, as indicated by hatching in FIG. 7, are disposed between the two parallel impedance transformers 16, 16 discretely in association with the lower conductive layers 18. The two longitudinal marginal portions of each isolation resistor 23 overlap the respective confronting edge portions of the two impedance transformers 16, 16, thus to avoid problems which may arise depending on whether or not the isolation resistor 23 is in direct contact with the impedance transformers 16, 16.

For assembly, the isolation resistors 23 are formed on the dielectric base 15 such as by the thin film technology. The lower conductive layers 18 are formed one on each isolation resistor 23. In addition, the common port 1, the two distributing ports 2, 3 and the impedance transformers 16, 16 are formed successively in the above-described structures.

The dielectric base 15, like the dielectrics 10*a*, 10*b* of the first embodiment, may comprise synthetic resin such as Teflon (trade name), or ceramics such as alumina.

Assuming that microwave power from the common port 1 is incident on the thus constructed power divider, the incident power is equally divided and outputted from the distributing ports 2, 3. At that time, each capacitor 17 of the impedance transformers 16 and the open stubs 4 acts as a resonator of a high-pass filter to cut off the microwave power of frequencies below any given frequency so that the microwave power of frequencies higher than the optional value are selectively outputted to the distributing ports 2, 3. The same thing can be said when the microwave powers inputted from the individual distributing ports 2, 3 are composed for being outputted from the common port 1.

Figure 9:
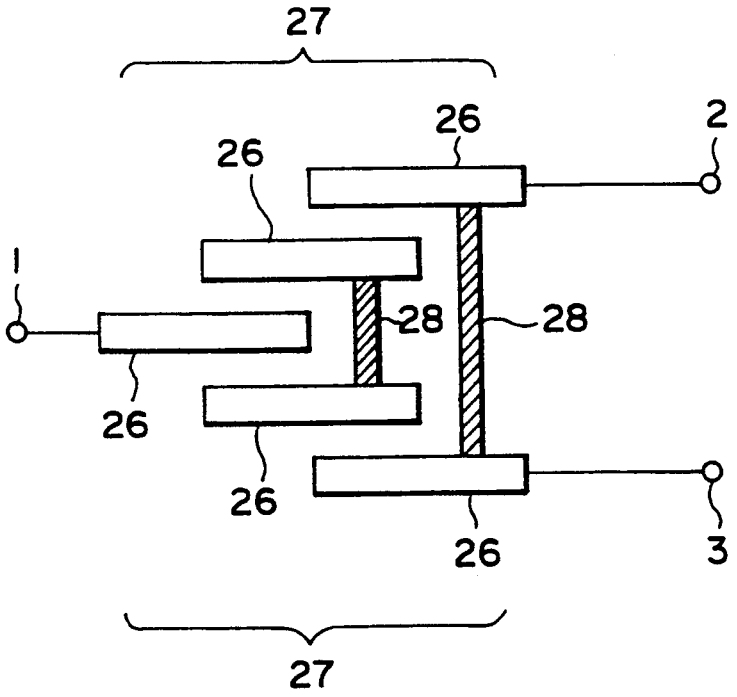
FIG. 9 is a schematic plan view showing a strip-line pattern to used in a fourth embodiment of the power divider.
Figure 10:
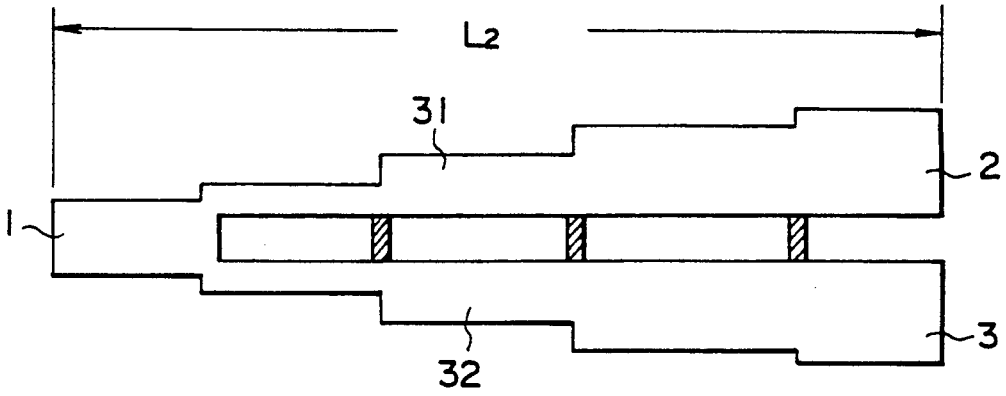
FIG. 10 PRIOR ART
FIG. 10 is a schematic plan view showing a prior art power divider using quarter-wavelength transformers.

In the foregoing embodiments, the power divider is equipped with the filter function of a low-pass filter or a high-pass filter. This invention should by no means be limited to these specific examples; for example, the power divider may have a band-pass filter. characteristic such as shown in FIG. 9.

In this embodiment, a plurality of lines 26, 26, of which the lengths are a half-wavelength of the central frequency of passage band, are stepped in order by a quarter-wavelength for every distributing port. In this way, impedance lines 27 having both band-pass filter function and impedance transformer function are provided with every distributing port. Like the foregoing embodiments, isolation resistors 28 are disposed between two lines 26 confronting each other. According to this embodiment, the microwave powers of frequencies in the range given by the filter characteristic are selectively outputted to the distributing ports 2, 3.

The same thing can be said when the microwave powers inputted from the individual distributing ports 2, 3 are composed for being outputted from the common port 1.

In each of the foregoing embodiments, input microwave power is equally divided. However, the case in which input microwave power is not equally divided may be used.

What is claimed is:

1. A power divider, which includes one or more conductor bases, one or more dielectrics and one or more strip conductors, for dividing and composing microwave power, said divider comprising:

(a) a common port and n distributing ports adapted to be connected to respective external lines; and (b) n impendance transformers, each including a filter structure for performing a filter function and each disposed between said common port and a respective one of said n distributing ports.

2. A power divider according to claim 1, wherein the transformation ratio of each said impendance transformer is set to n:1.

3. A power divider according to claim 1, wherein each said impedance transformer includes an impedance line having a higher impedance than a characteristic impedance on the distributing port side, and a resonator.

4. A power divider according to claim 3, wherein said resonator has a frequency characteristic so as to function as a low-pass filter.

5. A power divider according to claim 4, wherein said resonator includes a plurality of open stubs arranged along said impedance line.

6. A power divider according to claim 3, wherein the number of said distributing ports is two, each said impedance transformer corresponding to the respective distributing port including a respective one of two impedance lines arranged in parallel to each other.

7. A power divider according to claim 6, further including an isolation resistor disposed between said two impedance lines.

8. A power divider according to claim 3, wherein said common port, said distributing port and said impedance lines are constituted by said one or more dielectrics and said one or more conductors.

9. A power divider according to claim 8, wherein said one or more dielectrics includes first and second dielectrics laminated one over the other, said conductors, which constitute said common port, said distributing ports and said impedance lines, being disposed in a first surface of said first dielectric, said second dielectric being laminated over said first surface of said first dielectric, and a pair of conductor bases holding therebetween said first and second dielectrics in laminated posture.

10. A power divider according to claim 9, wherein the number of said distributing ports is two, the number of said impedance lines being two and being arranged in parallel to each other, said isolation resistor extending over confronting edge portions of said conductors constituting said two impedance lines.

11. A divider according to claim 1, wherein each said impedance transformer includes at least one capacitor array of capacitors connected in series, and a plurality of open stubs arranged along said capacitor array.

12. A power divider according to claim 11, wherein said capacitor array and said open stubs jointly constitute a high-pass filter.

13. A power divider according to claim 12, wherein the number of said distributing ports is two, the number of said capacitor arrays being two and being arranged in parallel to each other.

14. A power divider according to claim 13, further including at least one isolation resistor disposed between said two capacitor arrays.

15. A power divider according to claim 14, wherein said isolation resistor extends over confronting edge portions of said two capacitor arrays.

16. A power divider according to claim 11, wherein said one or more dielectrics includes at least three dielectric layers to be laminated one over another, said common port and said distributing ports being supported on the central one of said three dielectric layers, said three dielectric layers being sandwiches between said conductor bases in such a manner that each of said conductor bases is in contact with the outer surface of one of the two outside dielectrics.

17. A power divider according to claim 11, wherein said capactior array includes:

a lower conductive layer having a plurality of conductors arranged discretely on one surface of said one or more dielectrics, dielectric chips for constituting the capacitor being laminated over part of each conductors of the lower conductive layer; and an upper conductive layer having a plurality of conductors placed over respective dielectrics, the conductors of each said upper conductive layer being connected at one end to the succeeding conductor lower conductive layer.

18. A power divider according to claim 11, wherein said impedance transformer includes a plurality of lines, each having a length corresponding to a half-wavelength of the central frequency of passage band, said lines stepped in order by a quarter-wavelength for every distributing port.

19. A power divider according to claim 18, further including an isolation resistor disposed and extending between an adjacent pair of said lines associated with the different distributing ports.

20. A power divider comprising:

(a) a common port and N distributing ports; and (b) N low-pass filters each having an impedance transformer function and disposed between said common port and a respective one of said N distributing ports, each said low-pass filter including an impedance line which has an impedance higher than a characteristic impedance of the distributing-port side, said impedance line being provided with open stubs.

21. A power divider comprising:

(a) a common port and N distributing ports; and (b) N high-pass filters each having an impedance transformer function and disposed between said common port and a respective one of said N distributing ports, each said high-pass filter including a plurality of open stubs and a capacitor.

* * * * *

Disclaimer and Dedication 5,150,084—S. Hudson Owen, Marshfield, Wis.; Roger A. Baldwin, Warr Acres, Okla.; Gerald E. Taylor; Paul A. Wolff, Oklahoma City, Okla. METHOD FOR ADHESIVELY BONDING A RAIL-TIE FASTENING ASSEMBLY TO A WOODEN RAILWAY TIE. Patent dated Nov. 3, 1992. Disclaimer and dedication filed Apr. 30, 2003, by the assignee, Kerr-McGee Chemical LLC.

Hereby disclaims and dedicates to the Public, the remaining term of said patent.

*(Official Gazette, July 15, 2003)*